US009999921B2

(12) United States Patent
Wang et al.

(10) Patent No.: US 9,999,921 B2
(45) Date of Patent: Jun. 19, 2018

(54) METHOD OF MAKING ALUMINUM OR MAGNESIUM BASED COMPOSITE ENGINE BLOCKS OR OTHER PARTS WITH IN-SITU FORMED REINFORCED PHASES THROUGH SQUEEZE CASTING OR SEMI-SOLID METAL FORMING AND POST HEAT TREATMENT

(71) Applicant: GM Global Technology Operations LLC, Detroit, MI (US)

(72) Inventors: Yucong Wang, West Bloomfield, MI (US); Richard J. Osborne, Rochester, MI (US); Brian J. McClory, Royal Oak, MI (US)

(73) Assignee: GM GLOBAL TECHNOLOGY OPERATIOINS LLC, Detroit, MI (US)

( * ) Notice: Subject to any disclaimer, the term of this patent is extended or adjusted under 35 U.S.C. 154(b) by 356 days.

(21) Appl. No.: 14/739,042

(22) Filed: Jun. 15, 2015

(65) Prior Publication Data

US 2016/0361764 A1 Dec. 15, 2016

(51) Int. Cl.

| | |
|---|---|
| ***C22F 1/06*** | (2006.01) |
| ***B22D 27/20*** | (2006.01) |
| ***B22D 17/00*** | (2006.01) |
| ***B22D 17/08*** | (2006.01) |
| ***B22D 21/00*** | (2006.01) |
| ***B22D 25/02*** | (2006.01) |
| ***C22C 1/02*** | (2006.01) |
| ***C22C 1/10*** | (2006.01) |
| ***C22F 1/04*** | (2006.01) |

(52) U.S. Cl.

CPC ..... *B22D 27/20* (2013.01); *B22D 17/007* (2013.01); *B22D 17/08* (2013.01); *B22D 21/007* (2013.01); *B22D 25/02* (2013.01); *C22C 1/026* (2013.01); *C22C 1/1036* (2013.01); *C22F 1/04* (2013.01); *C22F 1/06* (2013.01)

(58) Field of Classification Search

CPC ..... B22D 27/20; B22D 17/007; B22D 17/08; B22D 21/007; B22D 25/02; C22F 1/04; C22F 1/06

See application file for complete search history.

(56) References Cited

U.S. PATENT DOCUMENTS

| | | | |
|---|---|---|---|
| 4,592,405 | A | 6/1986 | Allen |
| 5,289,388 | A | 2/1994 | Dahroug et al. |
| 5,803,154 | A | 9/1998 | Sugawara et al. |

FOREIGN PATENT DOCUMENTS

| | | | |
|---|---|---|---|
| CN | 1273244 | A | 11/2000 |

*Primary Examiner* — Jessee Roe

(57) ABSTRACT

A method of making a reinforced metal alloy component, the method including introducing a reinforcing phase precursor into a bulk alloy that is selected from the group consisting of high-entropy alloys, aluminum-based alloys, magnesium-based alloys and combinations thereof. The precursor is converted to a reinforcing phase by exposing the bulk alloy and precursor to an elevated temperature during one or more of a subsequent heat treating step, squeeze casting shaping or semi-solid metal shaping.

25 Claims, 4 Drawing Sheets

METHOD OF MAKING ALUMINUM OR MAGNESIUM BASED COMPOSITE ENGINE BLOCKS OR OTHER PARTS WITH IN-SITU FORMED REINFORCED PHASES THROUGH SQUEEZE CASTING OR SEMI-SOLID METAL FORMING AND POST HEAT TREATMENT

BACKGROUND TO THE INVENTION

This invention relates generally to a method to make light-weight metal-matrix composite components through squeeze casting or semi-solid metal (SSM) forming, and more particularly to making such components from a reinforced metal matrix composite where the reinforcing phase or phases are generated in-situ during such casting or forming operations.

Casting has become the dominant form of metal-forming operations for the manufacture of repeatable (i.e., high-volume) components (particularly those that employ light-weight metal alloys such as aluminum or magnesium), and includes numerous variants, such as die casting, permanent mold casting, sand casting, plaster casting, investment casting or the like. Nevertheless, it is known that the mechanical properties of cast components are often inferior to their wrought counterparts, due in no small part to porosity and related defects that are inherent in (or at least hard to avoid) known casting processes. Unfortunately, high-volume production and shape complexity considerations may render wrought options cost-prohibitive, if not outright impossible.

SSM forming techniques have helped to bridge the gap by providing metallic alloys that deliver wrought properties with a forming process capable of the large-scale production of complex shapes. In particular, the slurried (i.e., thixotropic) microstructure of these SSM techniques makes it easy to perform the semi-solid shaping by casting, forging or other known forming processes. In a conventional SSM forming process, a cast billet is (1) heated to a temperature above its recrystallization temperature yet below its solidus temperature; (2) extruded into a generally columnar form; (3) cut into shorter segments; (4) heated into a semi-solid state; and (5) squeezed into a cavity that is formed in a die set to form a part. Despite advantages, porosity, outer skin microstructure and related incomplete part formation issues persist in conventional SSM, especially in articles formed with complex geometries with thin or otherwise small features. Moreover, the billets used in this and related thixotropic processes are a highly specialized (and therefore expensive) way to achieve the desirable non-dendritic (i.e., globular) microstructure.

In a related way, squeeze casting has been investigated as a way to prepare components from lightweight alloys. The process is also referred to by other names, such as liquid metal forging, liquid die forging, semi-solid casting and forming, extrusion casting, pressurized solidification and pressurized crystallization. A conventional squeeze casting process is defined by the following steps: (1) pre-quantifying an amount of melt to be poured into a preheated die cavity; (2) ramping down a punch close to the die cavity; (3) pressurizing the molten metal and holding it there for a short period (for example, a few seconds) until the punch is withdrawn; and (4) ejection of the part from the die cavity. Thus, in one form, squeeze casting (and related liquid forging approaches) is simpler than SSM forming in that it uses a pre-determined volume of molten metal that is poured into a die cavity and squeezed under pressure during solidification, thereby forming the alloy parts in a single operation. Moreover, squeeze casting makes it possible to use wrought aluminum (or magnesium) alloy in a liquid state to form complex parts with intricate features. High direct melt pressure helps eliminate hot tearing and creates products with superior mechanical properties and low porosity. As such, squeeze casting is seen as a hybrid of conventional casting and forging techniques to achieve the strength and confidence level of forging with the high-volume economics and shape capabilities of castings.

It is known that increased structural or mechanical properties (such as elastic modulus, strength, fatigue resistance, creep resistance or the like) of components may be achieved through the introduction of reinforcing phases into the bulk alloy. As such, the class of materials known as composites has been created to help satisfy increasingly these and other demanding engineering requirements. One of the difficulties associated with creating such engineered composites is the cost associated with introducing disparate materials in such a way that they achieve the desired structural benefits in the final product. Because the introduction of a discreet reinforcing phase into a bulk alloy is complex (and therefore prohibitively expensive), it is incompatible for high-volume component production techniques for engine components through one or more of the traditional forms of metal casting mentioned above.

Significantly, the present inventors have discovered that traditional SSM or squeeze casting techniques have not been able to fully exploit all of the mechanical or structural properties that the use of such materials would otherwise offer. Specifically, the present inventors have determined that there remains a need to develop low-cost, durable engine components through a cost-effective, high-volume manufacturing approach that uses SSM, squeeze casting or related fabrication techniques to better exploit the high specific properties made possible by lightweight metal matrix composites.

SUMMARY OF THE INVENTION

To satisfy the above need, the present inventors have determined that the in-situ nucleation and growth of a reinforcing phase in a lightweight metallic alloy to make a composite may be triggered by an activating event of an added precursor material that occurs during a squeeze casting or SSM forming approach. One preferred form of such an activating event is a thermal one, where the precursor is exposed to an elevated temperature during the component-forming process. Regardless of the activating mechanism used to effect the thermally-based in-situ conversion of the precursors into the reinforcing phases that are dispersed throughout the lightweight metallic bulk alloy, the present inventors have discovered that the improved mechanical properties made possible by the composite-like nature of the formed components can be made in high volumes through SSM forming or squeeze casting in a manner similar to that of traditional die casting and other high-volume traditional casting approaches.

According to a first aspect of the present invention, a method of making a reinforced metal matrix composite component is disclosed. The method includes introducing one or more reinforcing phase precursors (also referred to herein as "nucleation site precursors", or more simply "precursors") into a bulk (i.e., feed) alloy, converting the precursors into reinforcing phases through an activation step and forming the component as a composite of the bulk alloy and the reinforcing phase or phases using squeeze casting or SSM forming in combination with optional post-forming heat treatment such that a linear dimension of the reinforcing phase is in the nanometer to micrometer range. The feed alloy is selected from the group consisting of aluminum-based alloys, magnesium-based alloys and so-called high-entropy alloys where in the present context, such "high-entropy" alloys are those that are made up of numerous (typically five or more) metals in approximately equal amounts. One such example is a combination of aluminum, lithium, magnesium, scandium and titanium. Such materials exhibit nanocrystalline configurations that possess high specific mechanical properties. Moreover, within the present context, such high-entropy alloys are deemed herein to be encompassed by the term "aluminum-based alloys", "magnesium-based alloys" or the like so long as the respective aluminum or magnesium is one of the predominant constituents (even if not the majority constituent). Significantly, the presence of the reinforcing phases that are generated during the activation helps the bulk alloy to take on composite-like attributes so that increases in certain mechanical properties (such as the elastic modulus) of the formed composite are realized. Unlike conventional composites where a reinforcing phase is added in its substantially final form, the reinforced phases of the various aspects of the present invention disclosed herein are formed in-situ during one or more of the liquid-solid transformation or subsequent heat treatment of the material.

As mentioned elsewhere, the choice of using squeeze casting or SSM forming may depend on the component being fabricated, as well as the choice of the bulk alloy being used. In situations where SSM forming is employed, two additional options are possible, a first of which includes providing the bulk alloy in particulate (i.e., solid, examples of which include granular, powder or related) form, and a second of which includes providing the bulk alloy in a substantially liquid (i.e., melted) form.

According to another aspect of the present invention, a method of making a reinforced metal matrix composite component includes introducing one or more reinforcing phase precursors into a bulk alloy that is selected from the group consisting of high-entropy alloys, aluminum-based alloys, or magnesium-based alloys, catalyzing the reinforcing phase precursor (or precursors) such that a reinforcing phase will form and grow before or as part of shaping the component as a composite of the bulk alloy and the one or more reinforcing phases. The shaping includes heating the mixture of bulk alloy and precursors until it is in an at least partially melted form, placing it into a die cavity and imparting an elevated pressure on the composite until a shape of the component defined by the die cavity has substantially solidified. As with the previous aspect, the shaping uses an SSM forming or squeeze casting operation, while the bulk alloy may be in either the particulate or molten state, and more than one die cavity (for example, a preliminary die cavity and a final die cavity) may be used.

According to yet another aspect of the present invention, a method of making a reinforced metal matrix composite component is disclosed. The method includes introducing one or more reinforcing phase precursors into a bulk alloy that is selected from the group consisting of high-entropy alloys, aluminum-based alloys, or magnesium-based alloys, and then shaping the component as a composite of the bulk alloy and a reinforcing phase that is formed by activation of the reinforcing phase precursor. The shaping is achieved by either squeeze casting or SSM forming, and includes heating the composite until it is in an at least partially melted form, placing the at least partially melted composite into a die cavity and imparting an elevated pressure on the composite until a shape of the component defined by the die cavity has substantially solidified. In one optional form, the growth of the reinforcing phases is partially (or in some cases, substantially) achieved by one or more subsequent heat treatment steps such that upon a catalytic reaction taking place in the bulk alloy, the reinforcing phases grow out of the precursor sites. In this way, the presence of the reinforcing phases is achieved in a way that differs from the conventional addition and subsequent mixing of discreet reinforcing phase particles into the bulk alloy.

BRIEF DESCRIPTION OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
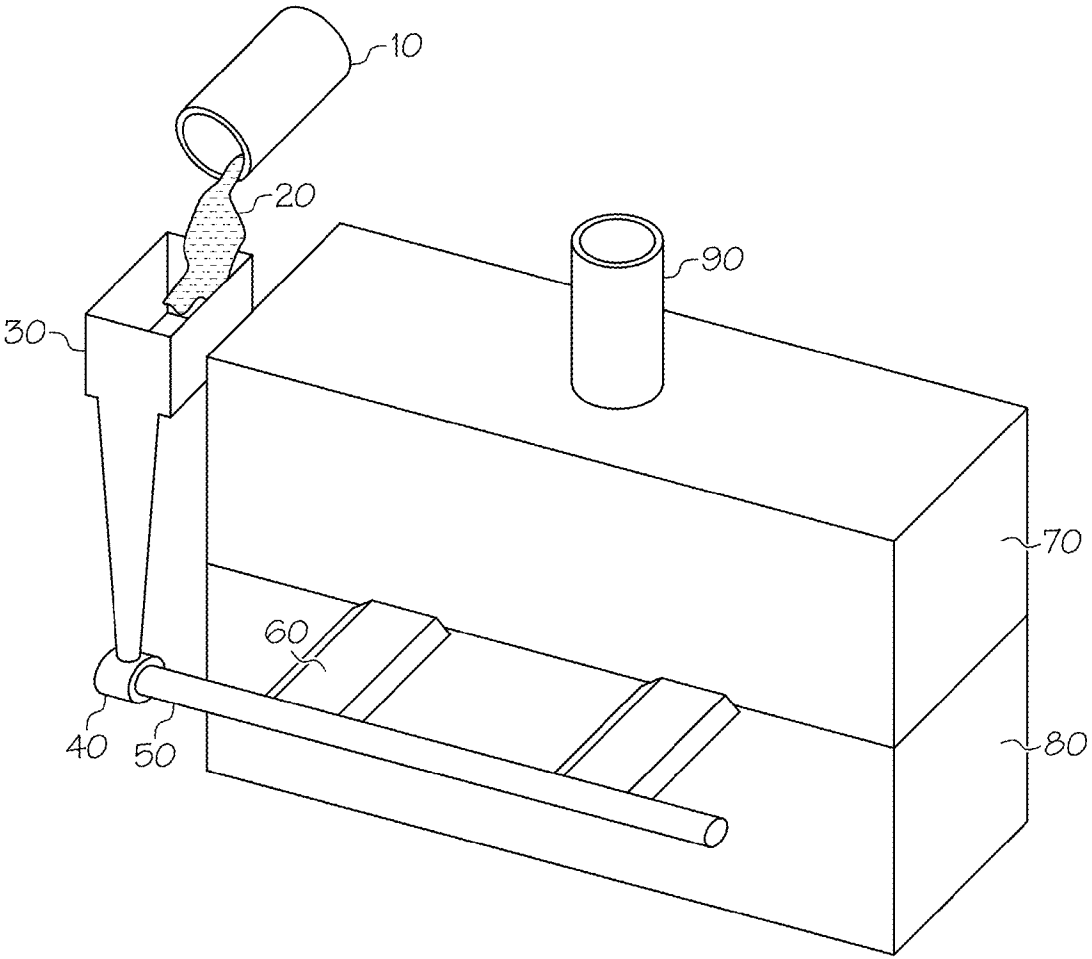
FIG. 1 shows a notional die casting system usable with the present invention.
Figure 4:
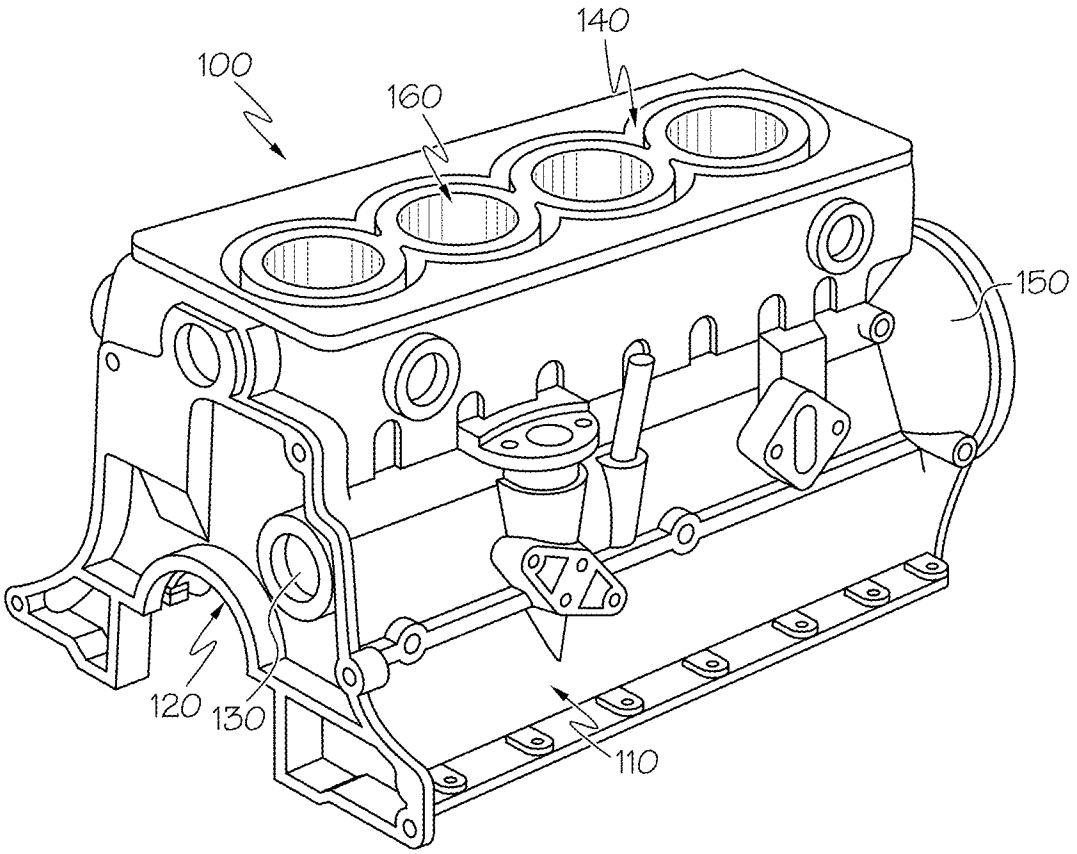
FIG. 4 shows an isometric view of a notional engine block that may be formed according to an aspect of the present invention.

Referring first to FIGS. 1 and 4, a representative casting approach similar to high pressure die casting shows a ladle 10 used to pour a molten metal 20 into a pouring basin 30 and down a sprue that terminates into a well 40. A shot sleeve 50 takes molten metal and delivers it under increased pressure (such as through a plunger (not shown)) to a series of gates 60 that feed a separable cope 70 and drag 80 that act as a housing for a die cavity therein that defines the representative shape of the component, such as engine block 100 that is depicted with particularity in FIG. 4. Intricate features, including—among other things—a crankcase 110, crankshaft bearing 120, camshaft bearing 130 (in the case of engines with overhead valves and pushrods), water cooling jackets 140, flywheel housing 150 and cylinder bores 160 may be defined by the cavity. A riser (also called a feeder) 90 is also included in the cope 70 in order to feed the casting to compensate for shrinkage that may occur during component cool-down and solidification. Although not shown, a comparable runner-based system may be employed for other forms of permanent (or semi-permanent) casting. In such a system the generally horizontal runner is used instead of the pressurized shot sleeve 50 of the die casting system above; either system is compatible with the present invention. For example, because both SSM forming and squeeze casting use fill times that are significantly slower than typical HPDC processes, the use of a runner-based feed may be especially useful within the present context.

Figure 2:
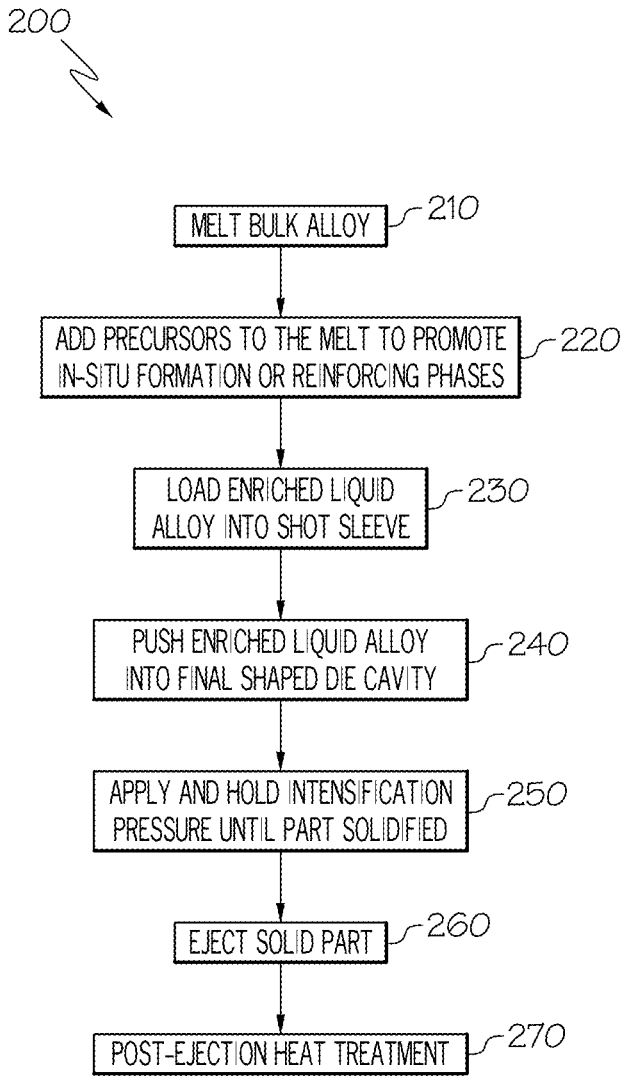
FIG. 2 shows a flow diagram of the use of squeeze casting with the system of FIG. 1 according to an aspect of the present invention.
Figure 3:
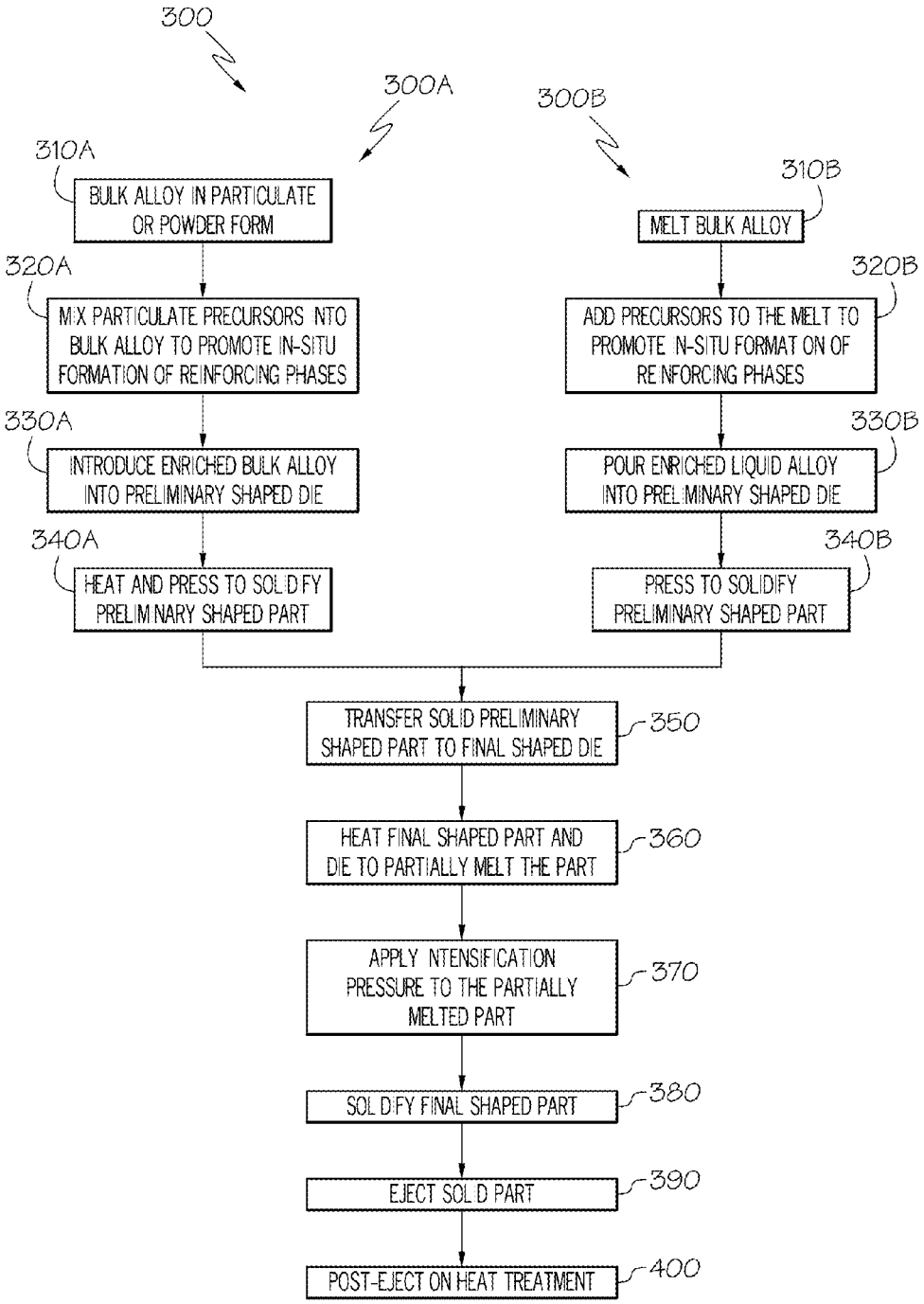
FIG. 3 shows a flow diagram of the use of SSM with the system of FIG. 1 according to another aspect of the present invention.

Referring next to FIGS. 2 and 3, flow charts showing steps used in forming the component under squeeze casting (FIG. 2) and SSM (FIG. 3) are shown. Both approaches are capable of forming articles with a fine-grained microstructure due to imparting a high pressure on at least partially molten metal during solidification. With particular regard to squeeze casting, the slow ingate velocities of the molten alloy avoid turbulence and gas entrapment so that during the freezing (i.e., solidification) cycle, high density and substantially porosity-free components may be produced. In the present context, the use of modifiers such as "increased", "elevated" or "high" in conjunction with pressures used in one or both of the preliminary and final die cavities represents values sufficient to achieve the necessary squeeze casting or liquid forging; such numbers are preferably between about 50 and 140 MPa for the former and about 40 to 100 MPa for the latter.

As mentioned above, SSM-based microstructures have superior flow characteristics when compared to those with dendritic microstructure, as the equiaxed microstructure of the billet feedstock can be heated to the semi-solid temperature range to convert the fine grained billet microstructure into the globulitic microstructure which allows a relatively free flowing (yet still viscous) fluid behavior. This in turn allows higher metal flow velocities without the attendant turbulence problems, which in turn significantly improves component production rates. In addition to SSM forming producing no turbulence during filling, it also uses a lower incoming metal temperature so that there less thermal shock to the tooling, employs shorter cycle times due to lower incoming metal temperature, and involves no handling of liquid metal, and produces a fine microstructure with low or no porosity and high mechanical properties. Squeeze casting affords similar advantages, including enjoying the benefit of: producing good surface finish (which contributes to reduced post-cast finishing), producing near net shape parts with almost no material waste, permitting on-site melting of any residual material as a way to reduce waste, and leaves the resulting components with fine microstructure, low or no porosity and high mechanical properties.

Referring with particularity to FIG. 2, various steps used in squeeze casting 200 according to an aspect of the present invention are shown. The steps include melting the bulk alloy 210, adding precursors to the melt such that upon attainment of a suitably elevated temperature, the reinforcing phases are formed in-situ 220, loading the liquid mixture of the bulk alloy and precursors (also referred to herein as an enriched alloy) into a shot sleeve 230, using the shot sleeve (such as shot sleeve 50 of FIG. 1) to push the enriched liquid alloy into a substantially final-shaped die cavity 240, applying and holding an elevated pressure to the alloy within the cavity until the component solidifies 250, removing (such as by ejecting) the solid part 260 and then performing optional post-ejection heat treatment 270. In one form, the heating of the reinforcing phase precursors may be through induction heating. Moreover, while the remainder of the disclosure preferably depicts using horizontal shot sleeves and related runners and gates with which to provide feed to the cavities, it will be appreciated by those skilled in the art that vertical or other non-horizontal feed schemes may also be employed and still be deemed to be within the scope of the present invention. In a most preferred form, engine blocks and other automotive components may be made by combining the in-situ generation of one or more reinforcing phases into the bulk alloy through either squeeze casting or SSM forming processes. The resulting particle-reinforced, high stiffness composites exhibit superior stiffness compared to their non-reinforced counterparts, yet avoid the cost and complexity of traditional composite-forming approaches.

Referring with particularity to FIG. 3, various steps used in SSM forming 300 according to an aspect of the present invention are shown. In fact, two parallel paths 300A, 300B are possible, depending on whether it is preferable to start with the bulk alloy in powder/particulate form or in molten form. Both of these paths are explained. For situations where the bulk alloy is in particulate, powder or related solid form, the steps of path 300A include providing the bulk alloy 310A, mixing particulate precursors into the bulk alloy 320A, introducing the combination or mixture of the bulk alloy and reinforcing phase precursors into a preliminary-shaped die 330A, heating (along with pressure) to solidify the preliminarily-shaped part 340A. Likewise, for situations where the bulk alloy is to be in a molten form prior to the introduction of the reinforcing phase precursors, the steps of path 300B include melting the bulk alloy 310B, adding precursors to the melt to promote the in-situ formation of the reinforcing phases 320B, pour the liquid alloy mixture into the preliminarily-shaped die 330B, and then press to solidify the preliminarily-shaped part 340B.

Regardless of which of the two parallel paths 300A, 300B are used, subsequent steps include transferring the solid preliminarily-shaped part to a final shaped die 350, heating the finally-shaped part and die in order to partially melt the part 360, applying elevated pressure to the partially-melted part 370 in order to help solidify it in a substantially final shape 380, ejecting the solidified part 390 and performing any optional post-ejection heat treatment 400. In one preferred form, the post-ejection heat treatment 400 may help to further develop the desired microstructures, including uniformly distributed reinforcing phases of different sizes ranging from nanometers to micrometers. With appropriate selection of the precursors to seed the nucleation sites, the particles of the reinforcing phase will be higher in elastic modulus than the bulk alloy, thereby providing additional stiffness of the resulting composite part. In a preferred form, the precursor would be soluble in the alloy at a temperature above which the alloy is solid such that a catalyzing activation arising from increases in temperature, pressure or other energy source (such as ultrasound, vibration or electromagnetism) will promote the formation of the nucleation sites so that the reinforcing phase particles will grow at the nucleation sites to micro size because of one or more of structure, size and composition at the site. The resultant reinforcing particles will themselves be insoluble in the alloy at some temperature below the temperature at which they nucleated, and may be in the form of compounds including (but not limited to) ceramics, intermetallics or dispersoids, as well as a combination of them. Such ceramics may include silicon carbide, silicon nitride, silicon oxide, boron carbide, boron nitride, titanium nitride, titanium carbide, titanium oxide, silicon aluminum oxynitride, steatite (magnesium silicates), aluminum oxide (alumina) and zirconium dioxide (zirconia, which can be chemically stabilized in several different forms, or in metastable structures that can impart transformation toughening, such as the less brittle partially stabilized zirconia). Likewise, suitable intermetallics may include FeAl, $Fe_3Al$, $FeAl_3$, FeCo, $Cu_3Al$, NiTi, NiAl, $Ni_3Al$, $Ag_3Sn$, $Cu_3Sn$, $TiSi_2$, $MgCu_2$, $MgZn_2$, $MgNi_2$, CuZn, $Cu_{31}Sn_8$, SbSn as well as others containing three or more elements. Compounds of low cost rare earth elements such as Ce and La may also be used. The precursors that lead to the reinforcing particles can be added separately or together during the process, depending on the need. Significantly, the precursor achieves two things: first, it provides nucleation sites at which the reinforcing phase particles can grow, and second, it provides the elements which will feed the reinforcing phase growth. As such, they may (or may not) be made from a single composition. Moreover, they may be coated (as discussed below) so that the outside composition is different from that of the core that is controlled by the growth of the various reinforcing phases.

In one preferred form, activation that results in forming the reinforcing phases at the nucleation sites includes catalyzing the one or more precursors through increasing the temperature of the bulk alloy above its solidus temperature. Once the precursor has been catalyzed, the resulting reinforcing phase avoids reverting back in the presence of the liquid melt by virtue of their relatively high melting temperatures in conjunction with their nucleation taking place at temperatures around or above the liquidus temperature $T_L$ of common aluminum and magnesium die casting alloys. In fact, these reinforcing phases (preferably in the form of particles) actually can be nucleated over a fairly wide range of temperature (for example, between about 200° to 800° C.), depending on the solution in which the nucleation happens, as well as upon the size of the reinforcing phase. For example, smaller radius particles form at lower melting temperature due to their high surface energy. In situations where use of an aluminum-based material is contemplated, the present inventors believe an activation temperature range of about 500° C. to 800° C. would be sufficient, while an activation temperature range of about 425° C. to 700° C. would be proper for a magnesium-based material. Within the context of the present invention, it is expected that the nucleation to occur around the liquidus temperature $T_L$ of typical casting alloys examples of which are shown in the table below.

| | Solidus Temperatures | | Liquidus Temperatures | |
|---|---|---|---|---|
| Alloy | ° C. | ° F. | ° C. | ° F. |
| Al 356.0 | 557 | 1035 | 613 | 1135 |
| Al 380.0 | 538 | 1000 | 593 | 1100 |
| Al 2014 | 507 | 945 | 638 | 1180 |
| Mg AZ91 | 470 | 878 | 595 | 1100 |
| Mg AM60 | 545 | 1010 | 615 | 1140 |

Proper choice of the reinforcing phases will ensure that they remain solid even in the very hot bulk alloy due to their high melting point. For example, the melting temperature of one typical reinforcing oxide particle, titanium dioxide $TiO_2$, is 1843° C. or 3350° F. As is understood by those skilled in the art, liquidus temperature $T_L$ and solidus temperature Ts such as those depicted in the table above are a function of materials compositions based on phase diagrams. Thus, a good solidus Ts temperature range for aluminum would be between about 500° C. and 700° C., while a desirable liquidus temperature $T_L$ range would be between about 550° C. and 750° C. Likewise, a preferred solidus temperature $T_S$ range for magnesium alloys would be between about 425° C. and 600° C., with a corresponding liquidus temperature $T_L$ range of about 550° C. to 700° C.

Moreover, activation of the precursors through the catalyzation steps discussed herein improves wettability through reduced interfacial energy; this in turn produces improvements in the desired reinforcing phases. Thus, in addition to controlling the size of the reinforcing phase, the precursors can be coated (especially when in ceramic form) with metals that generally have low-melting points, or compound particles by mechanical milling, as well as by mixing them in a solvent and then dried. The solvent or carrier (which may remain or be removed after processing) may be used to improve transformation process efficiency or effectiveness by helping reduce the interfacing energy between the surfaces of particles, as well as to avoid particle clustering. The solvent or carrier can be organic or inorganic chemicals, such as alcohol, chlorinated solvents, or commercially-available industrial solvent, as well as solid lubricant such as boron nitride powder, molybdenum disulfide ($MbS_2$) powder or the like.

A significant benefit to using squeeze casting or SSM forming with the present composite-generating approach is that nontraditional compositions of aluminum or magnesium casting alloys may be used, including those with significant non-eutectic compositions that—while possessing valuable attributes for engine blocks and related automotive components—have hitherto been avoided due in part to the difficulty in casting such alloys into repeatable, high-quality finished products. Likewise, alloys traditionally associated with forged materials (such as aluminum-copper, aluminum-magnesium (either with or without additional alloying ingredients) may be used with the present invention, thereby opening up the range of usable materials to ones deemed hitherto inappropriate for low-cost, high-volume component manufacture. By way of example, the hypereutectic Alloy 390 is traditionally difficult to use because of the inability to maintain a desirable microstructure as a way to control the size and distribution of primary silicon during the casting process. By reducing the influence of the high heat of fusion associated with formation of primary silicon, the combination of squeeze casting or liquid forging with the in-situ composite formation discussed herein avoids traditional long cycle times and concomitant shortened tool life that previously limited the applicability of this (as well as other) alloys. The possibility of using hard-to-cast alloys (such as from the Al/Cu class of alloys) is especially desirable in the formation of engine block 100 in that the cylinder bores defined therein may be produced in a "bare-bore" configuration where no separate iron-based cylinder liners or other inserts would be needed. Moreover, traditional hypoeutectic alloys (such as Alloys 319 and 356, each with roughly 6 to 7 percent Si) that the Assignee of the present disclosure currently uses for engine blocks, as well as near-eutectic alloys (such as Alloy 380, with roughly 9% Si) may be beneficially used with the methods disclosed herein.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. Moreover, the term "substantially" is utilized herein to represent the inherent degree of uncertainty that may be attributed to any quantitative comparison, value, measurement, or other representation. As such, it may represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of making a reinforced metal alloy component, said method comprising:

introducing at least one reinforcing phase precursor into a bulk alloy that is selected from the group consisting of aluminum-based alloys, magnesium-based alloys, high-entropy alloys and combinations thereof; and forming said component as a composite of said bulk alloy and at least one reinforcing phase that is produced upon activation of said at least one reinforcing phase precursor by using either squeeze casting or semi-solid metal forming such that a linear dimension of said at least one reinforcing phase is in the nanometer to micrometer range.

2. The method of claim 1, wherein said activation comprises catalyzing said at least one reinforcing phase precursor by increasing the temperature of said bulk alloy above its solidus temperature.

3. The method of claim 2, wherein said activation further takes place in at least one subsequent heat treating step.

4. The method of claim 2, wherein said introducing by said squeeze casting comprises having said bulk alloy be in melted form at the time said at least one reinforcing phase precursor is added thereto.

5. The method of claim 4, wherein said forming comprises:

maintaining said composite in a substantially melted form;

placing said substantially melted composite into a shot sleeve;

forcing said substantially melted composite into a substantially final shape die cavity; and maintaining an elevated pressure on said substantially melted composite until a final shape of said component defined by said final shape die cavity has substantially solidified.

6. The method of claim 5, wherein said substantially final shape die cavity is shaped to define an automobile component.

7. The method of claim 5, further comprising heat treating said component once it has been has substantially solidified.

8. The method of claim 1, wherein said activation comprises catalyzing said at least one reinforcing phase precursor by at least one of increasing the pressure on said reinforcing phase precursor, applying ultrasonic vibration to said reinforcing phase precursor and applying an electromagnetic field to said reinforcing phase precursor.

9. The method of claim 1, wherein said aluminum-based bulk alloy is selected from the group consisting of eutectic alloys, near-eutectic alloys, hypoeutectic alloys, hypereutectic alloys and forged alloys.

10. The method of claim 1, wherein said reinforcing phase defines a higher modulus of elasticity than said bulk alloy.

11. The method of claim 1, wherein said reinforcing phase is selected from the group consisting of ceramics, intermetallics, rare earth elements and dispersoids.

12. The method of claim 1, wherein said introducing by said semi-solid metal forming comprises providing said bulk alloy in particulate form at the time said at least one reinforcing phase precursor is introduced thereto.

13. The method of claim 12, wherein said forming comprises:

introducing said composite into a substantially preliminary shape die cavity; and providing a combination of heat and pressure until a preliminary shape of said component defined by said preliminary shape die cavity has substantially solidified.

14. The method of claim 13, further comprising:

transferring said solidified composite to a substantially final shape die cavity;

heating said substantially final shape die cavity such that said solidified composite therein is at least partially melted; and applying additional pressure to said at least partially melted composite until a final shape of said component defined by said final shape die cavity has substantially solidified.

15. The method of claim 14, wherein said substantially final shape die cavity is shaped to define an automotive engine block.

16. The method of claim 13, further comprising heat treating said component once it has been has substantially solidified.

17. The method of claim 1, wherein said introducing by said semi-solid metal forming comprises:

maintaining said composite in a substantially melted form;

placing said substantially melted composite into a substantially preliminary shape die cavity; and providing a combination of heat and pressure until said substantially melted composite defined by said preliminary shape die cavity has substantially solidified.

18. The method of claim 17, further comprising:

transferring said solidified composite from said preliminary shape die cavity to a substantially final shape die cavity;

heating said substantially final shape die cavity such that said solidified composite therein is at least partially melted; and applying additional pressure to said at least partially melted composite until a final shape of said component defined by said final shape die cavity has substantially solidified.

19. A method of making a reinforced metal alloy component, said method comprising:

introducing at least one reinforcing phase precursor into a bulk alloy that is selected from the group consisting of high-entropy alloys, aluminum-based alloys, magnesium-based alloys and combinations thereof;

catalyzing said reinforcing phase precursor such that a reinforcing phase will grow therefrom; and forming said component as a composite of said bulk alloy and said reinforcing phase using one of squeeze casting and semi-solid metal, said forming comprising:

heating said composite until it is in an at least partially melted form;

placing said at least partially melted composite into a die cavity; and imparting an elevated pressure on said at least partially melted composite until a shape of said component defined by said die cavity has substantially solidified.

20. The method of claim 19, wherein said bulk alloy is in a substantially solid powder form at the time said at least one reinforcing phase precursor is introduced thereto.

21. The method of claim 19, wherein said bulk alloy is in a substantially melted liquid form at the time said at least one reinforcing phase precursor is introduced thereto.

22. The method of claim 19, wherein said reinforcing phase is selected from the group consisting of ceramics, intermetallics, rare earth elements and dispersoids.

23. A method of making a reinforced metal alloy component, said method comprising:

introducing at least one reinforcing phase precursor into a bulk alloy that is selected from the group consisting of high-entropy alloys, aluminum-based alloys, magnesium-based alloys and combinations thereof; and shaping said component as a composite of said bulk alloy and a reinforcing phase that is formed by activation of said reinforcing phase precursor, said shaping selected from the group consisting essentially of squeeze casting and semi-solid metal forming, said shaping comprising:

heating said composite until it is in an at least partially melted form;

placing said at least partially melted composite into a die cavity; and imparting an elevated pressure on said at least partially melted composite until a shape of said component defined by said die cavity has substantially solidified.

24. The method of claim 23, wherein said activation comprises catalyzing said at least one reinforcing phase precursor by increasing the temperature of said bulk alloy during at least one of said shaping or at least one subsequent heat treating step.

25. The method of claim 24, wherein said activation comprises catalyzing said at least one reinforcing phase precursor by increasing the temperature of said bulk alloy above its solidus temperature during said shaping and increasing the temperature of said reinforced metal alloy component during at least one subsequent heat treating step.

* * * * *